US006236166B1

(12) United States Patent
Chou et al.

(10) Patent No.: US 6,236,166 B1
(45) Date of Patent: May 22, 2001

(54) STRUCTURE AND METHOD FOR ARRANGING POLES IN A PLASMA DISPLAY PANEL

(75) Inventors: Pin-Hung Chou; Kuang-Lang Chen; Yao-Hung Lai, all of Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 0 days.

(21) Appl. No.: 09/492,916

(22) Filed: Dec. 16, 1999

(51) Int. Cl.[7] ..... G09F 9/00

(52) U.S. Cl. ..... 315/169.1; 315/169.4; 345/55

(58) Field of Search ..... 315/169.1, 169.3, 315/169.4; 313/582, 583, 584; 345/55, 67, 68

(56) References Cited

U.S. PATENT DOCUMENTS 5,852,347 * 12/1998 Marcotte ..... 315/169.4

* cited by examiner

*Primary Examiner*—David Vu
(74) *Attorney, Agent, or Firm*—Bacon & Thomas, PLLC

(57) ABSTRACT

A structure and method for arranging poles in a plasma display panel comprises a plurality of spaced apart parallel X poles and Y poles on an inner surface of plasma display panel wherein each X pole is adjacent to a Y pole. Power contacts are formed on either ends of X and Y poles. As such, once an open circuit occurred in one of poles in the manufacturing process, power contact at one end associated with the malfunctioned pole may be connected to the power contact of the pole at the other end. As such, the malfunctioned pole may be powered continuously so as to discharge. With this, the quality of plasma display panel is not significantly adversely affected by the defect, thus increasing yield and resulting in an increase in the manufacturing cost.

16 Claims, 9 Drawing Sheets

STRUCTURE AND METHOD FOR ARRANGING POLES IN A PLASMA DISPLAY PANEL

FIELD OF THE INVENTION

The present invention relates to a plasma display panel, and more particularly to a structure and method for arranging poles in a plasma display panel.

BACKGROUND OF THE INVENTION

A conventional plasma display panel 10 is shown in FIG. 1 wherein one glass substrate 11 has a different arrangement from the other glass substrate 12 thereon. Glass substrate 11, 12 are sealed together in their respective peripheral edges. Then a neon, xenon, any of other inert gases, or any combination thereof is filled in the enclosed discharge space. The substrate 11 facing viewer is front substrate 11. From the inner surface of front substrate 11 toward rear substrate 12, a plurality of parallel transparent poles 111, bus poles 112, a dielectric layer 113, and a protective layer 114 are sequentially formed thereon. Correspondingly, a plurality of parallel spacer walls 122 are formed wherein between any of two adjacent spacer walls 122, a data pole 121 is formed on rear substrate 12, a dielectric layer 124 is covered on data pole 121, and a uniform fluorescent element 123 is formed to cover dielectric layer 124 and the opposing surfaces of spacer walls 122.

In the following description two adjacent parallel transparent poles 111 (including bus poles 112) are called X pole and Y pole respectively. These X and Y poles and the corresponding data pole 121 on rear substrate 12 form a three-pole, unit such that corresponding dielectric layers 113, 124 may discharge on a discharge cell 13 formed in the space defined by X pole, Y pole, and two adjacent spacer walls 122 when a predetermined voltage is applied on the poles. As a result, a corresponding light is emitted by fluorescent element 123. These equally spaced parallel poles 111 (i.e., X and Y poles) on front substrate 11 are formed by thick or thin film technique in the prior art plasma display panel 10 manufacturing process. The number of poles depends on the resolution of plasma display panel.

Referring to FIG. 2, a pole arrangement of the prior art plasma display panel 10 shown in FIG. 1 is schematically illustrated. A shortbar 21 is provided on one end of front substrate 11 for connecting together the front ends of X poles. Shortbar 21 is connected to two short flexible printed circuits 22 which in turn are connected to bulk sustainer 23 such that bulk sustainer 23 may supply voltage needed for X poles discharge. At the other end of front substrate 11, Y poles (labeled as Y1, Y2, Y3, . . . , Y6) are divided into two groups wherein one group (Y1, Y2, and Y3) is connected to electrical signal contacts 251 of scan driver 25 through a flexible printed circuit 24, and the other group (Y4, Y5, and Y6) is also connected to electrical signal contacts 251 of scan driver 25 through a flexible printed circuit 24 such that scan driver 25 may supply scanning signal needed for Y pole displaying.

Referring to FIG. 3, another pole arrangement of the prior art plasma display panel 10 shown in FIG. 1 is schematically illustrated. This pole arrangement is different from the one shown in FIG. 2 as detailed below. That is, shortbar 21 is omitted such that X poles are connected to short flexible printed circuit 26 directly in one end of front substrate 1. Short flexible printed circuits 26 are connected to shortbar 27 which in turn connects to bulk sustainer 23 such that bulk sustainer 23 may supply voltage needed for X poles discharge.

In the manufacturing process of above front substrate 11, an open circuit 115 (i.e., break) may occur in an arbitrary position in either X pole or Y pole during its respective pole etching process as illustrated in FIG. 4. As such, the pole (i.e., either X pole or Y pole) associated with the open circuit 115 is not. connected to bulk sustainer 23 or scan driver 25, thus disrupting power supply. As a result, a normal discharge is made impossible. This causes a line defect on the pole in plasma display panel 10. This line defect adversely affects the quality of plasma display panel, thus lowering yield and resulting in an increase in the manufacturing cost.

SUMMARY OF THE INVENTION

It is therefore an object of the present invention to provide a structure and method for arranging poles in a plasma display panel comprising a plurality of spaced apart parallel X poles and a plurality of spaced apart parallel Y poles on an inner surface of plasma display panel wherein each X pole is adjacent to a Y pole. Two power contacts are formed on either end of X pole. Also two power contacts are formed on either end of Y pole. As such, once an open circuit occurred in one of poles in the manufacturing process, power contact at one end associated with the malfunctioned pole may be connected to the power contact of the pole at the other end. As such, the malfunctioned pole may be powered continuously so as to discharge. With this, the quality of plasma display panel is not significantly adversely affected by the defect, thus increasing yield and resulting in a decrease in the manufacturing cost.

It is another object of the present invention to provide a structure and method for arranging poles in a plasma display panel wherein power lines or connecting poles to bulk sustainer and scan driver respectively are provided in a superimposition relation on two different surfaces of a double-layer flexible printed circuit. Also the superimposed positions of the lines are as close to one end of the poles on the double-layer flexible printed circuit as possible so as to decrease the length of the parallel portions of adjacent lines, thereby significantly decreasing the coplanar stray capacitance generated on the flexible printed circuit.

It is still another object of the present invention to provide a structure and method for arranging poles in a plasma display panel wherein a shortbar in the power lines for connecting X poles to one of bulk sustainers is provided on a periphery of a single layer flexible printed circuit. A plurality of spaced apart parallel lines are extended from either of two opposing ends of shortbar toward the center. Each of the spaced apart parallel lines is connected to a corresponding X pole. A plurality of spaced apart parallel lines are provided on the center of flexible printed circuit each connected to a corresponding Y pole. These lines are only spaced apart parallel each other in a minimum length in the region near either end of the flexible printed circuit adjacent to the shortbar. As a result, a coplanar stray capacitance and a superimposed stray capacitance are eliminated in the single-layer flexible printed circuit. This further significantly decreases the manufacturing cost.

The above and other objects, features and advantages of the present invention will become apparent from the following detailed description taken with the accompanying drawings.

DETAILED DESCRIPTION OF PREFERRED EMBODIMENTS

Figure 1:
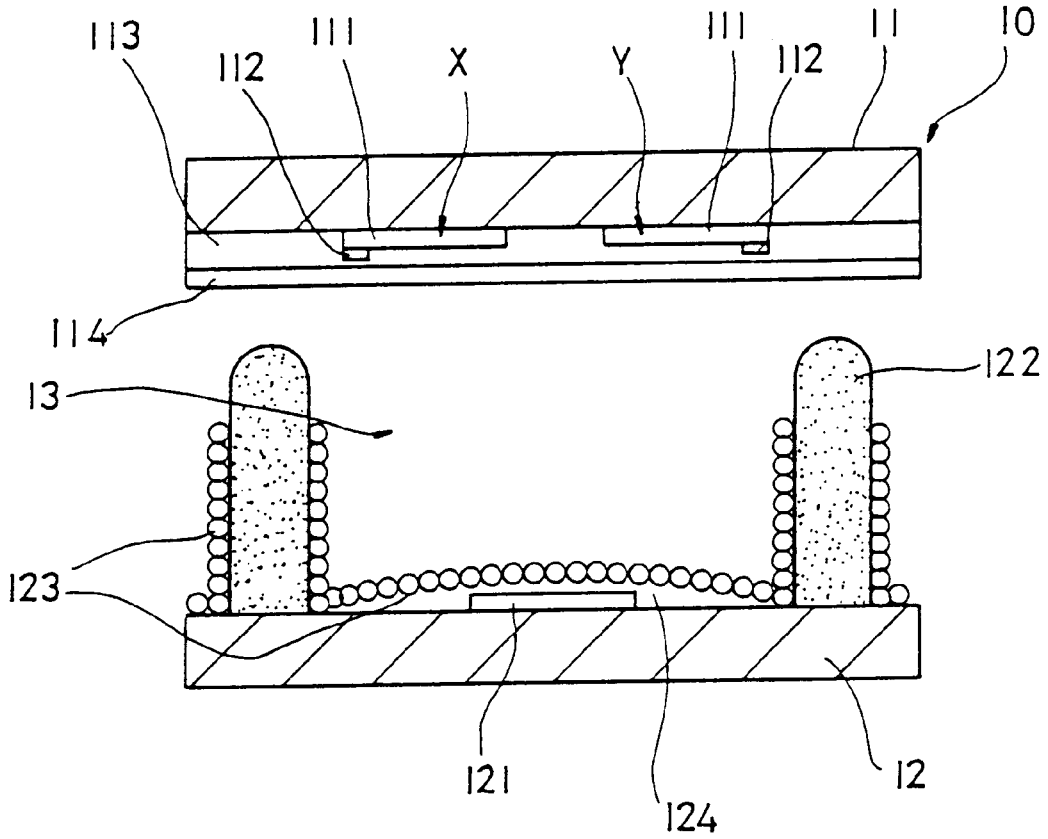
Fig. 1 Prior art
FIG. 1 is a sectional. view of a prior art plasma display panel.
Figure 2:
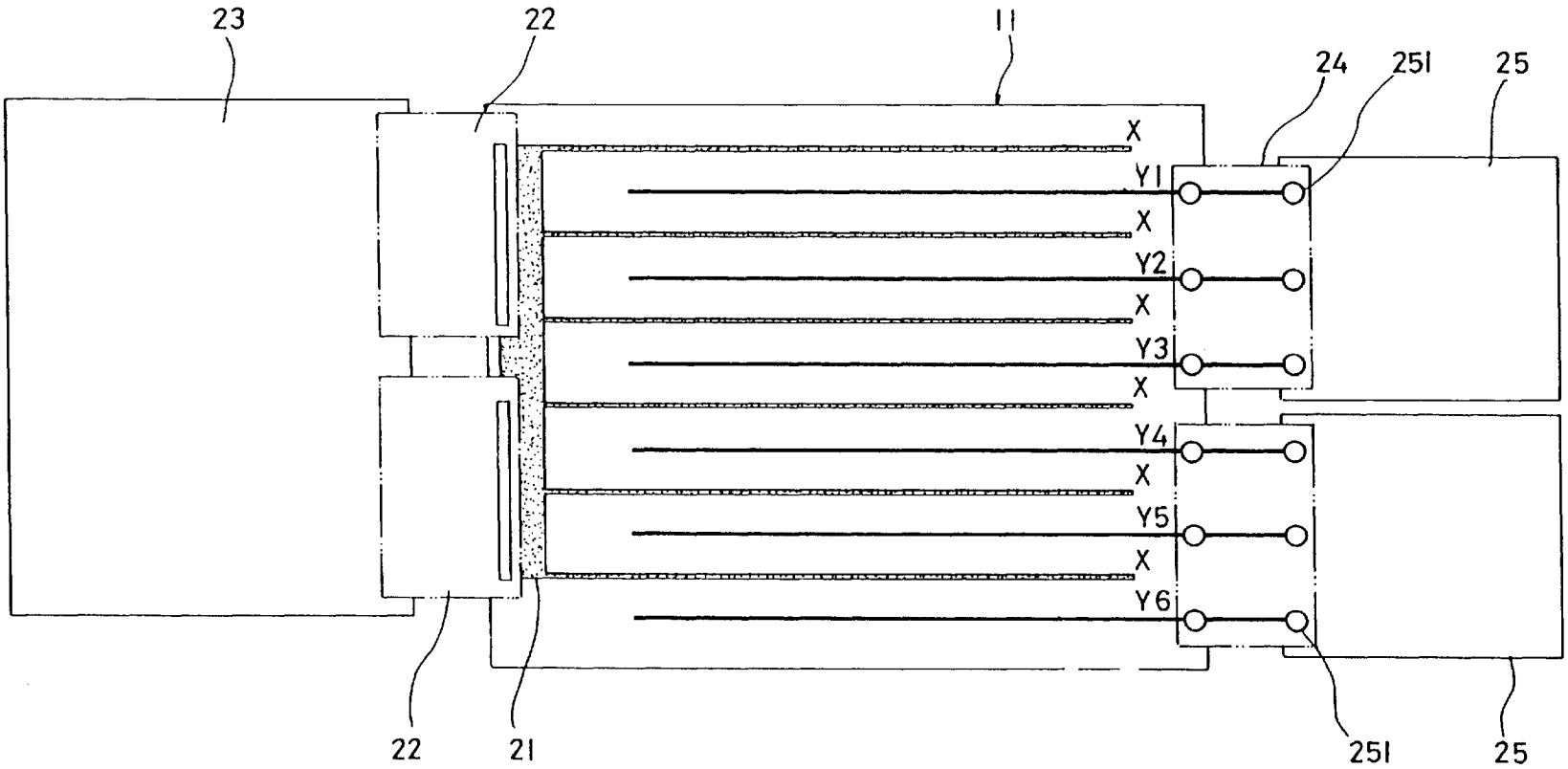
Fig. 2 Prior art
FIG. 2 schematically illustrates a pole arrangement of FIG. 1.
Figure 3:
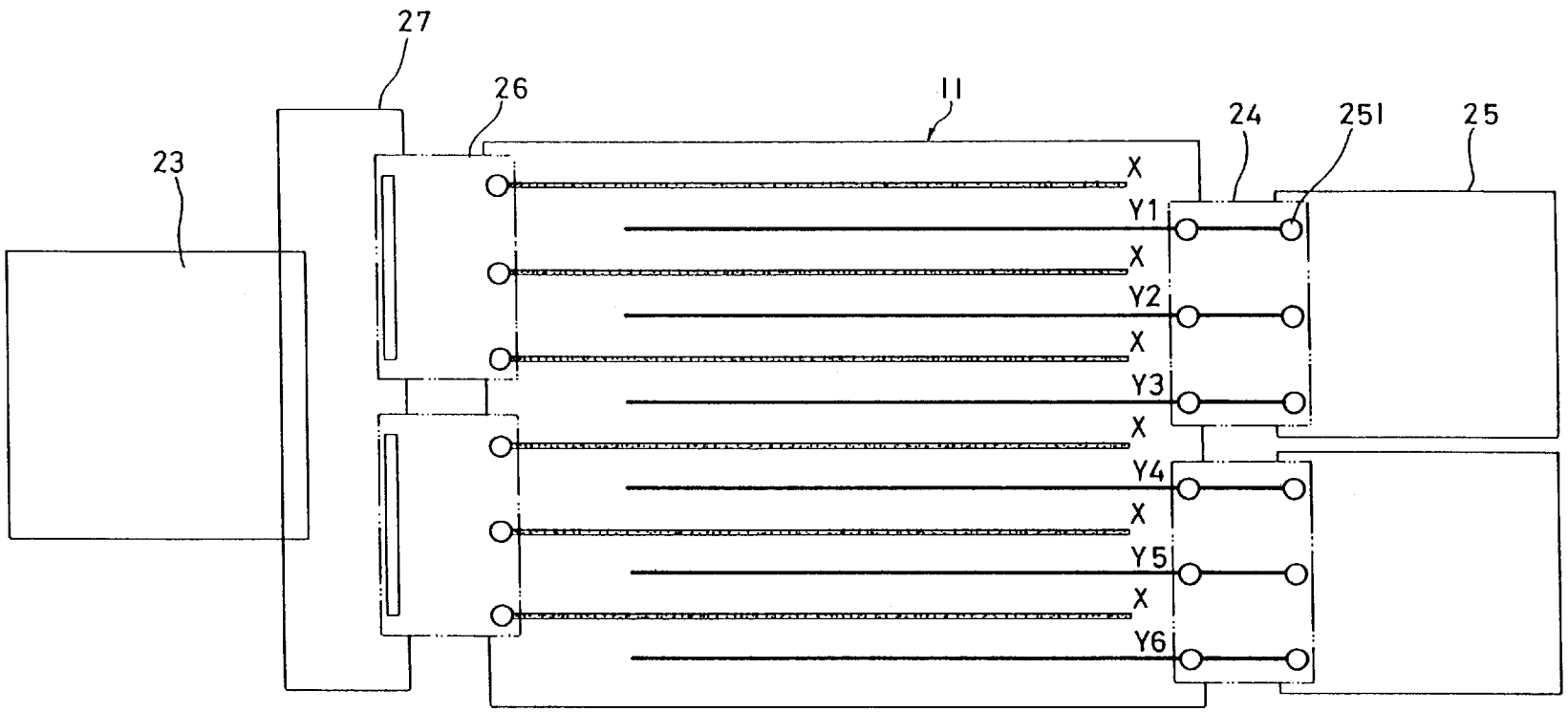
Fig. 3 Prior art
FIG. 3 schematically illustrates another pole arrangement of FIG. 1.
Figure 4:
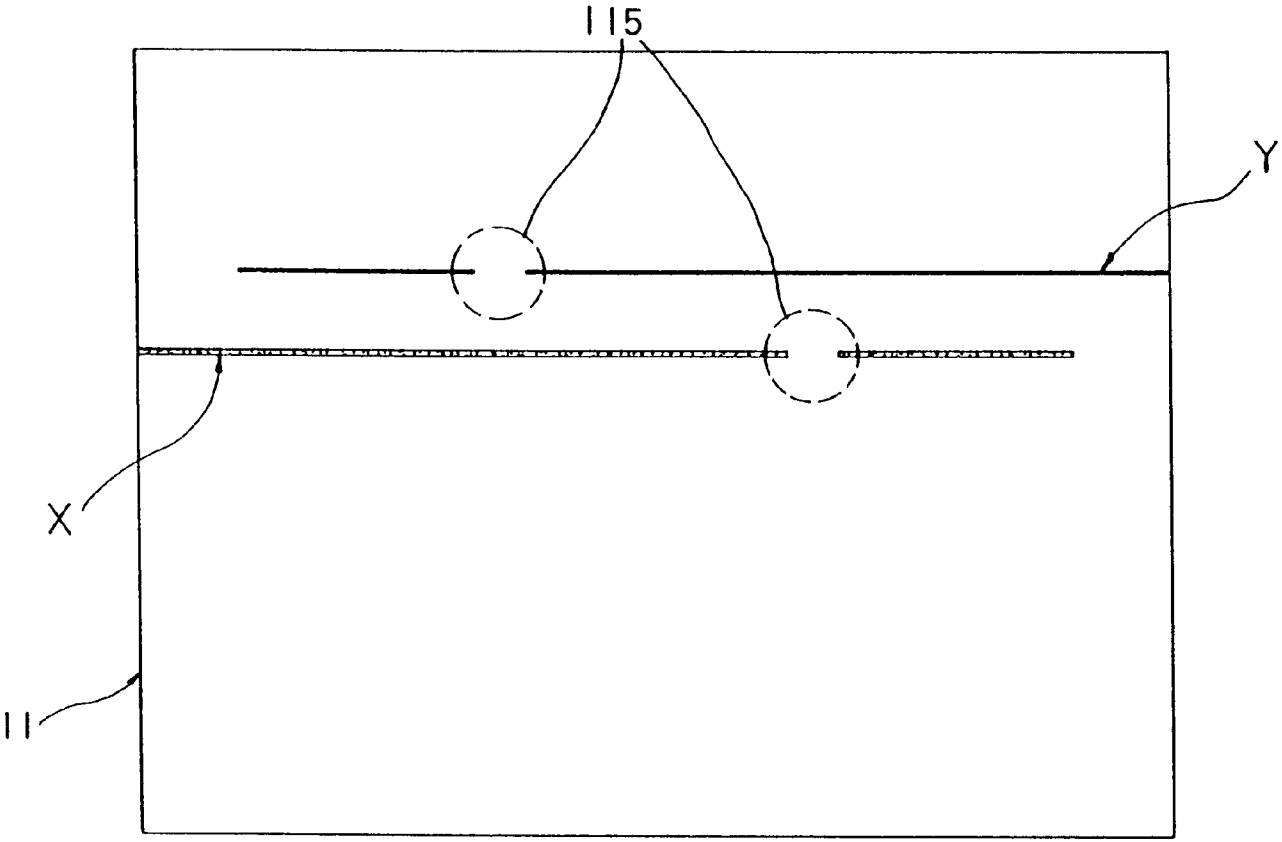
Fig. 4 Prior art
FIG. 4 is an enlarged fragmentary view of the prior art poles showing line defects thereon.
Figure 5:
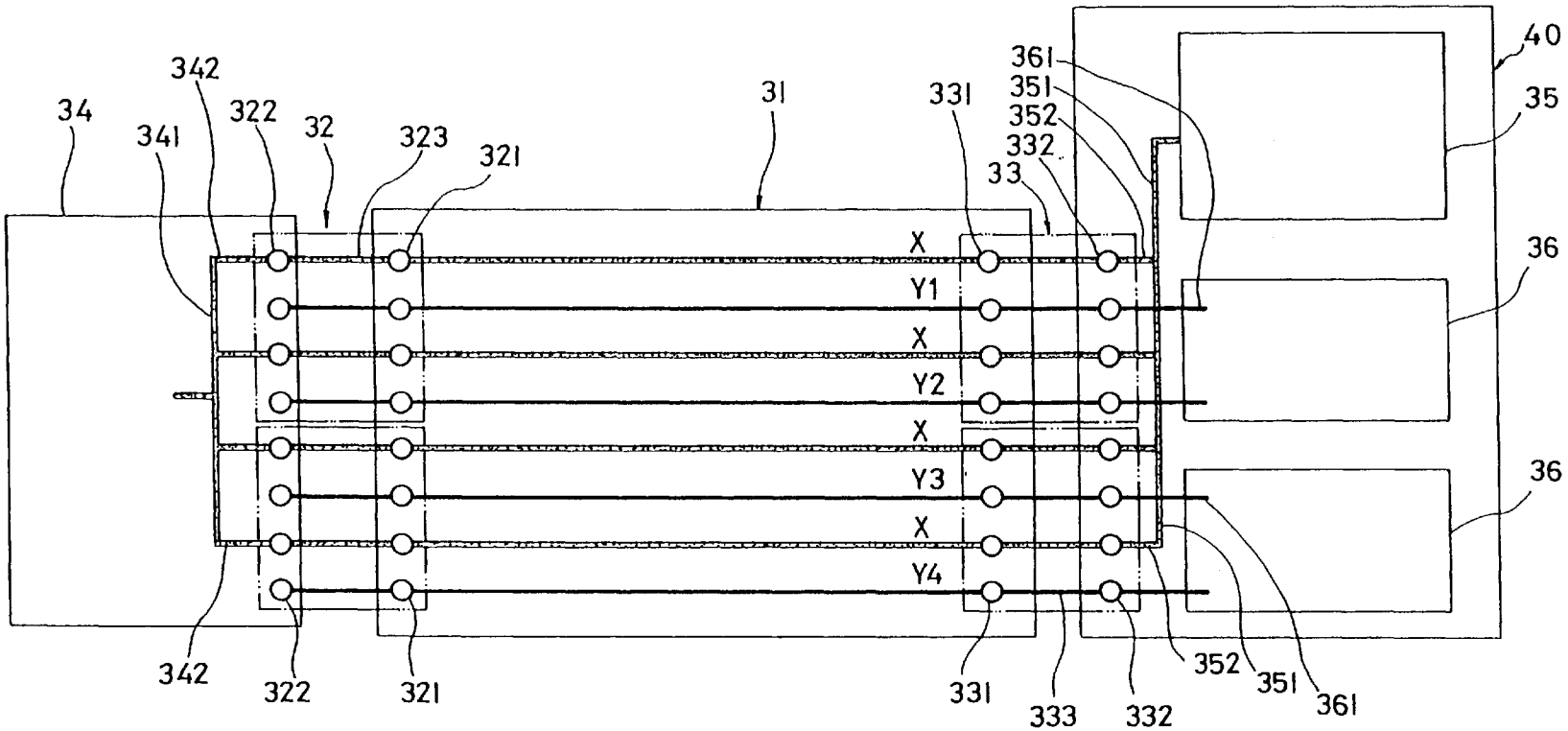
FIG. 5 schematically illustrates a first embodiment of structure for arranging poles in a plasma display panel according to the invention.

Referring to FIG. 5, there is shown a structure for arranging poles in a plasma display panel constructed in accordance with the present invention. A plurality of equally spaced parallel poles 111 (i.e., X and Y poles (including Y1 pole, Y2 pole, Y3 pole, . . . )) on front substrate 31 are formed by thick or thin film technique in the plasma display panel manufacturing process. X poles are connected between two sides of front substrate 31, i.e., connected between side contacts 321 of a first flexible printed circuit 32 and side contact 331 of a second flexible printed circuit 33. The contacts 321 and 331 are connected to corresponding contacts 322 and 332 respectively which in turn connects to power line 342 of shortbar 341 of a first bulk sustainer 34 and power line 352 of shortbar 351 of a second bulk sustainer 35 respectively. As such, first and second bulk sustainers 34 and 35 may supply voltage needed for X poles discharge. Similarly, Y poles are connected between two sides of front substrate 31, i.e., connected between side contacts 321 of first flexible printed circuit 32 and side contact 331 of second flexible printed circuit 33. Note that the contacts 322 associated with Y poles on the other side of first flexible printed circuit 32 corresponding to contacts 321 are not connected to any power lines. The contacts 332 on the other side of second flexible printed circuit 33 corresponding to contacts 331 are connected to power lines 361 of scan drivers 36. As such, scan drivers 36 may supply scanning signal needed for Y poles displaying. In this embodiment of the invention, scan drivers 36 are parallel connected to second bulk sustainer 35 in a circuit board 40. The shortbar 351 of second bulk sustainer 35 and power lines 361 of scan drivers 36 are provided in different layers of circuit board 40 in order to prevent second bulk sustainer 35 from shorting on power lines 361.

Figure 6:
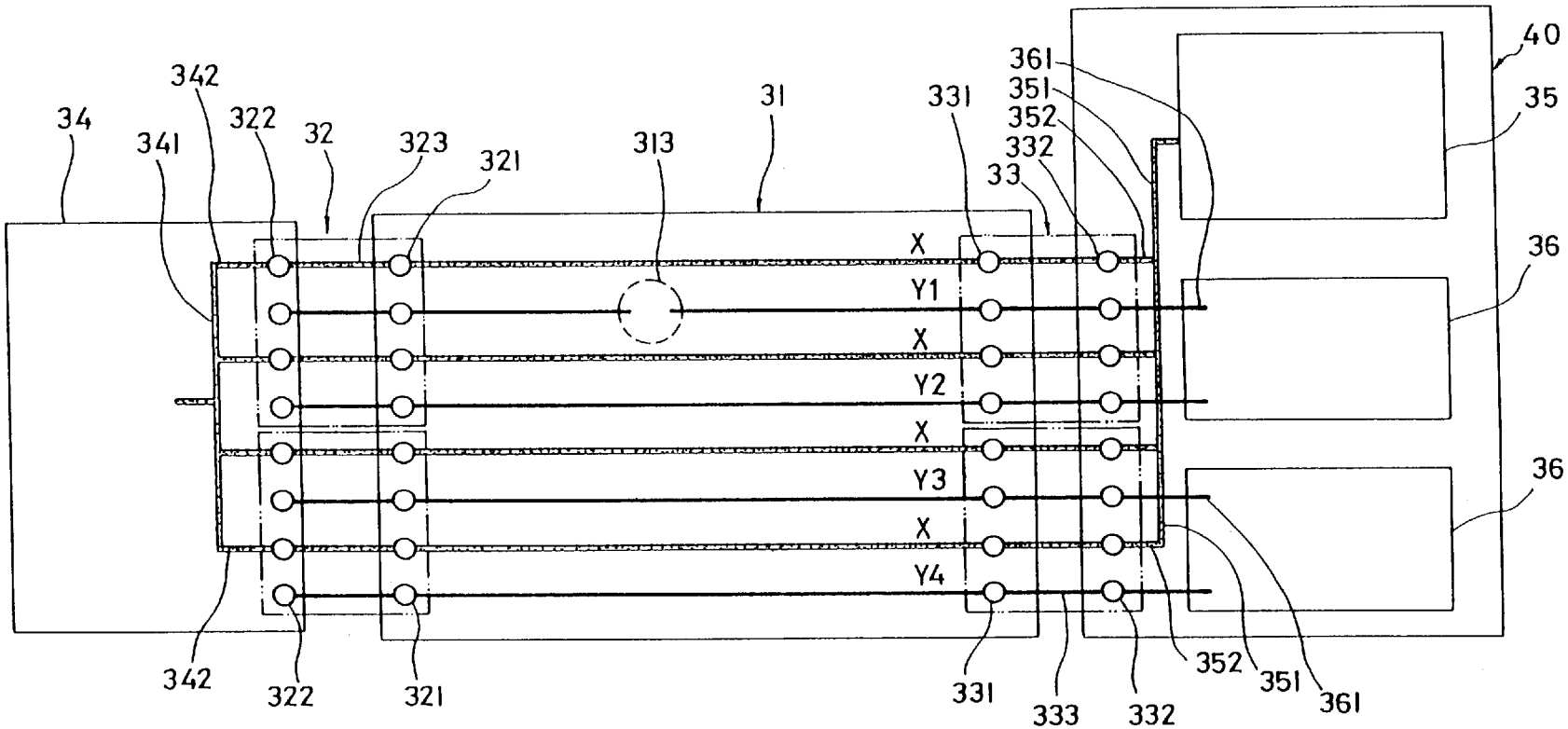
FIG. 6 schematically illustrates an open circuit on a pole shown in FIG. 5.

In the manufacturing process of front substrate 31 of the invention, an open circuit (i.e., break) may occur in an arbitrary position in either X pole or Y pole during its respective pole etching process as illustrated in FIG. 6. As shown, the open circuit 313 is on Y1 pole. As an end, the Y1 pole associated with the open circuit 313 is not electrically connected to scan driver 36, thus disrupting power supply. As a result, a normal discharge is made impossible. This causes a line defect on Y1 pole. A solution proposed by the invention is that the malfunction Y1 pole associated with the unconnected contact 322 of first flexible printed circuit 32 may be connected to the power contact 332 of second flexible printed circuit 33 at the other end of the Y1 pole. As such, the line defect is improved to a point defect (i.e., in open circuit 313). As an end, the malfunctioned pole may be powered continuously so as to discharge. With this, the quality of plasma display panel is not significantly adversely affected by the open circuit defect, thus increasing yield and resulting in an increase in the manufacturing cost.

Figure 7:
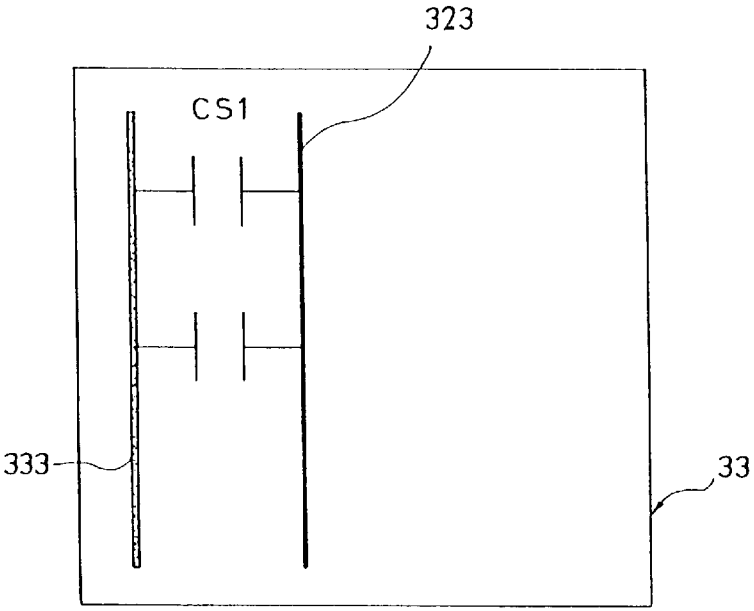
FIG. 7 schematically illustrates a coplanar stray capacitance formed between two adjacent poles of FIG. 5.

For the pole arrangement shown above, the spaced apart parallel plurality of lines 323 of first flexible printed circuit 32 and the spaced apart parallel plurality of line 333 of second flexible printed circuit 33 are connected to X poles and Y poles respectively wherein each line 323 is adjacent to line 333. As such, a coplanar stray capacitance CS1 exists between these lines 323 and 333 as shown in FIG. 7.

Figure 8:
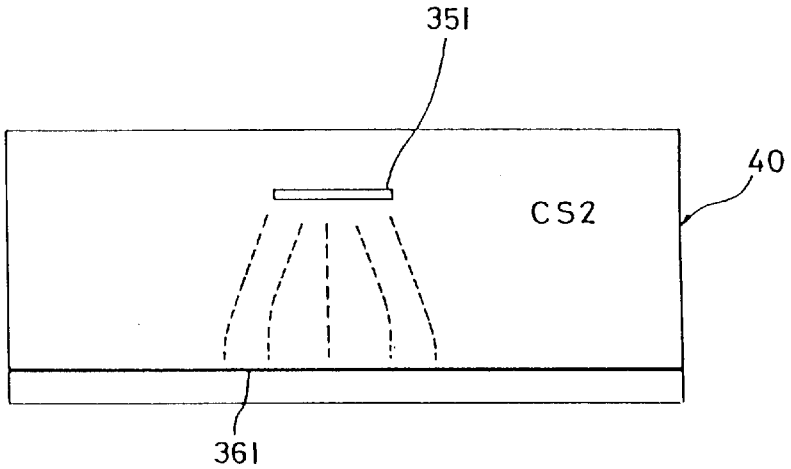
FIG. 8 schematically illustrates a non coplanar stray capacitance formed between shortbar of bulk sustainer and power line of scan driver of FIG. 5.

Further, shortbar 351 of second bulk sustainer 35 and power lines 361 of scan drivers 36 are superimposed on different surfaces of circuit board 40. As such, a superimposed stray capacitance CS2 also exists therebetween as shown in FIG. 8.

A capacitive coupling phenomenon may occur in these stray capacitance when plasma display panel is activated to display. This may cause a line loss and wave distortion. To the worse, it may adversely affect the discharge of the plasma display panel, thereby decreasing the resolution of display.

Figure 9:
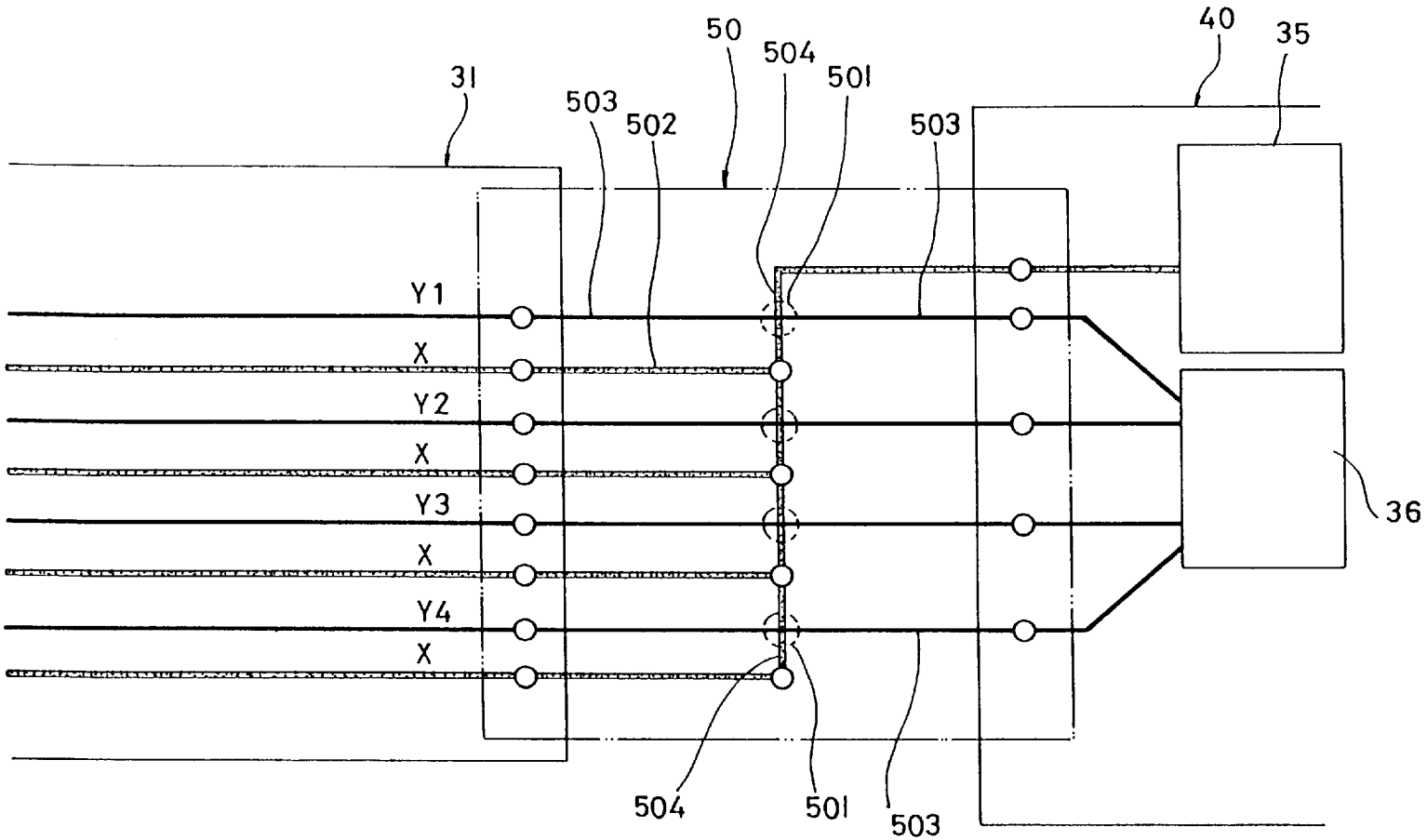
FIG. 9 schematically illustrates a second embodiment of structure for arranging poles in a plasma display panel according to the invention.

Referring to FIG. 9, a second embodiment of the invention is shown. A double-layer flexible printed circuit 50 is provided in replacement of the above bulk sustainers. In detail, above shortbar 351 of second bulk sustainer 35 and power lines 361 of scan drivers 36 are superimposed on two different surfaces of double-layer flexible printed circuit 50. Also the superimposed positions 501 of the lines 503 and 504 are as close to one end of the X and Y poles on the double-layer flexible printed circuit 50 as possible so as to decrease the length of the parallel portions of adjacent lines 502 and 503, thereby significantly decreasing the coplanar stray capacitance CS1 generated on the flexible printed circuit 50.

Figure 10:
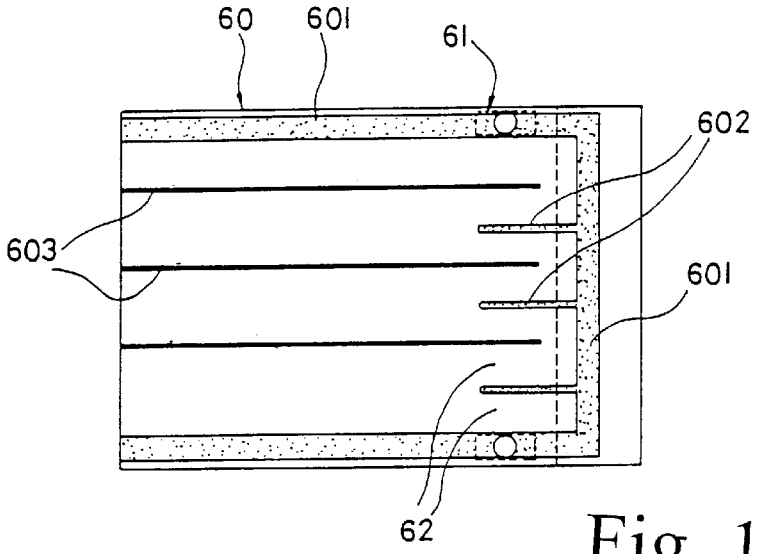
FIG. 10 schematically illustrates a third embodiment of structure for arranging poles in a plasma display panel according to the invention.

In this embodiment, the insulator layer provided between two different surfaces of double-layer flexible printed circuit 50 has a thickness smaller than that of the insulator layer provided between two different surfaces of circuit board 40. As a result, an even higher superimposed stray capacitance CS2 may exist in the superimposed position 501 between shortbar 504 of second bulk sustainer 35 and power lines 503 of scan driver 36. For improving coplanar stray capacitance and superimposed stray capacitance of above embodiments, a technique is proposed in a third embodiment of the invention as shown in FIG. 10. The shortbar 601 on flexible printed circuit connected to bulk sustainer is provided on a periphery of a flexible printed circuit 60 with each of a plurality of alignment marks 61 near the junction between two sides of shortbar 601. A plurality of spaced apart parallel lines 602 are extended a short distance from either of two opposing ends of shortbar 601 toward the center. Each of the spaced apart parallel lines 602 is connected to a corresponding X pole. Further a plurality of spaced apart parallel lines 603 are provided on the center of flexible printed circuit 60 each connected to a corresponding Y pole. These lines 602 and 603 are only spaced apart parallel each other in a minimum length in the region near either end of the flexible printed circuit 60 adjacent to the shortbar 601.

Figure 11:
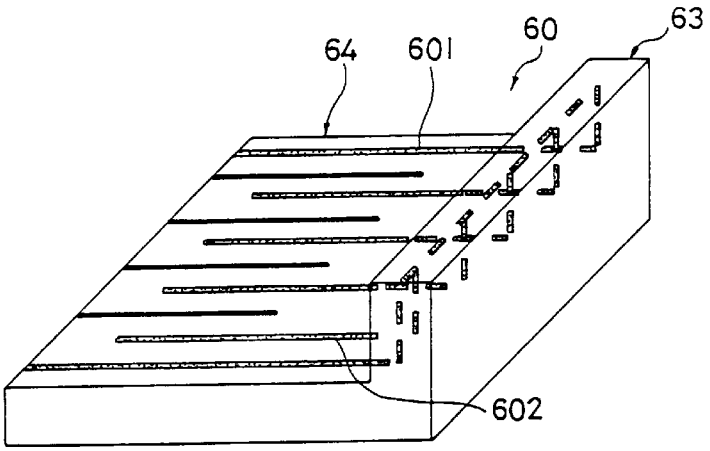
FIG. 11 is an angled view of FIG. 10 showing the bent portion.

Referring to FIG. 11, an upward bent portion 63 is formed at either end of shortbar 601 of flexible printed circuit 60. As such, a corresponding contact may form on lines 602 and 603 at either side of a planar plane 64 of flexible printed circuit 60.

Figure 12:
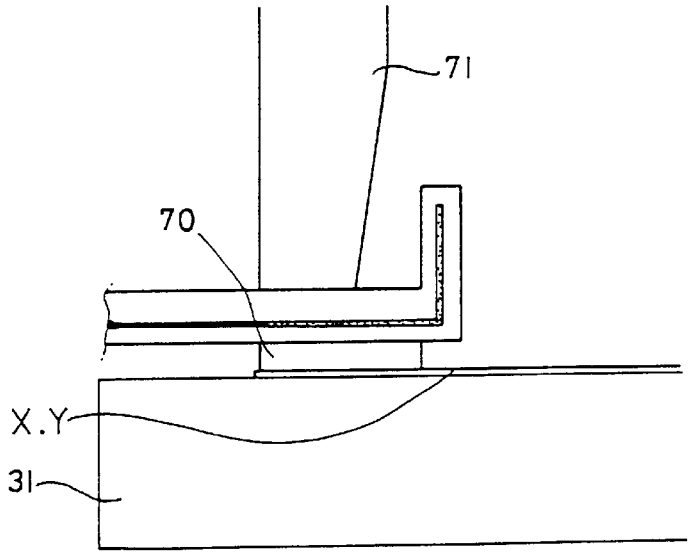
FIG. 12 is an environmental sectional view of FIG. 11.

Referring to FIG. 12, an anisotropic conductive film 70 is provided on the contacts shown in FIG. 11. Then a hot head 71 is pressed on one end of X poles and Y poles on front substrate 31.

It is seen that lines 602 and 603 connected to corresponding X poles and Y poles respectively are not adjacent to each other. As a result, a wider spacing is obtained between two adjacent lines 603 which in turn significantly decreases the coplanar stray capacitance CS1. Further, shortbar 601 connected to X poles and bulk sustainer is not provided in a superimposition relation with lines 603. As a result, a superimposed stray capacitance CS2 is eliminated. Furthermore, since a single-layer flexible printed circuit is implemented in this embodiment, a reduced manufacturing cost is resulted as compared to double-layer flexible printed circuit.

While the invention herein disclosed has been described by means of specific embodiments, numerous modifications and variations could be made thereto by those skilled in the art without departing from the scope of the invention set forth in the claims.

What is claimed is:

1. A structure for arranging poles in a plasma display panel comprising:

a first bulk sustainer having a plurality of power contacts;

a front substrate having a plurality of spaced apart parallel X and Y poles formed on the inner surface wherein each of the X poles is adjacent to each of the Y poles, and each of the poles consisting of a transparent pole and a bus pole;

a first flexible printed circuit having a plurality of contacts in one end connected to ends of the X and Y poles, a first plurality of contacts in the other end connected to the power contacts of the first bulk sustainer which corresponding to the plurality of contacts connected to the X poles, and a second plurality of contacts in the other end unconnected;

a second bulk sustainer having a plurality of power contacts;

a scan driver having a plurality of power lines; and a second flexible printed circuit having a plurality of contacts in one end connected to the other ends of the X and Y poles, a first plurality of contacts in the other end connected to power contacts of the second bulk sustainer which corresponding to the plurality of contacts connected to the X poles, and a second plurality of contacts in the other end connected to the power contacts of the scan driver, wherein when an open circuit occurs in one of the X and Y poles, the contact associated with the open circuit on the pole in one end of one of the flexible printed circuits being connected to the contact of the pole having the open circuit in the other end of the other flexible printed circuit for continuing powering the pole having the open circuit so as to discharge.

2. The structure of claim 1, wherein the second bulk sustainer comprises a shortbar for connecting the second bulk sustainer to the contacts of the second flexible printed circuit in the other end.

3. The structure of claim 2, further comprising a circuit board with the scan driver and the second flexible printed circuit parallel provided thereon, and the shortbar of the second bulk sustainer and the power lines of the scan driver are provided on two different surfaces of the circuit board.

4. The structure of claim 2, wherein the second flexible printed circuit is a double-layer flexible printed circuit, and the shortbar of the second bulk sustainer and the power lines of the scan driver are provided on two different surfaces of the double-layer flexible printed circuit.

5. The structure of claim 4, wherein the shortbar of the second bulk sustainer and the power lines of the scan driver are superimposed on two different surfaces of the double-layer flexible printed circuit being close to ends of the poles on the double-layer flexible printed circuit in a minimum predetermined distance.

6. The structure of claim 2, wherein the shortbar is provided on a periphery of the flexible printed circuits with a plurality of spaced apart parallel lines extended from either of two opposing ends of the shortbar toward the center, each of the spaced apart parallel lines connected to the corresponding X pole, and a plurality of spaced apart parallel lines provided on the centers of the flexible printed circuits each connected to the corresponding Y pole such that the lines are only spaced apart parallel each other in a minimum length in a predetermined region near either end of each of the flexible printed circuits adjacent to the shortbar.

7. The structure of claim 6, further comprising an upward bent portion formed at either end of each of the flexible printed circuits adjacent to the shortbar so as to form a corresponding contact on the power lines at either end of the planar plane of each of the flexible printed circuits for pressed on ends of the X and Y poles on the front substrate.

8. The structure of claim 6 or 7, wherein the shortbar is provided besides the left and right alignment marks thereof.

9. A method for arranging poles in a plasma display panel comprising the steps of:

forming a front substrate having a plurality of spaced apart parallel transparent X and Y poles on the inner surface with each of the X poles adjacent to each of the Y poles;

forming a plurality of power contacts on either ends of the X and Y poles; and when an open circuit occurs in one of the X and Y poles in the manufacturing process, connecting the contact associated with the open circuit on the pole in one end to the power contact of the pole having the open circuit in the other end for continuing powering the pole having the open circuit so as to discharge.

10. The method of claim 9, wherein the X poles on the front substrate having one end connected to contacts of a first flexible printed circuit and the other end connected to contacts of a second flexible printed circuit, and power contacts of, the flexible printed circuits in the other end connected to power lines of a shortbar attached to a first bulk sustainer and a second bulk sustainer so as to supply voltage needed for X poles discharge.

11. The method of claim 10, wherein the Y poles on the front substrate having contacts in one end connected to the contacts of the first flexible printed circuit, while the other corresponding power contacts of the first flexible printed circuit unconnected, and contacts in the other end connected to the contacts of the second flexible printed circuit, while the other corresponding power contacts of the second flexible printed circuit connected to power lines of a scan driver so as to supply scanning signals needed for the Y poles displaying.

12. The method of claim 11, wherein the scan driver and the second flexible printed circuit parallel provided thereon, and the shortbar of the second bulk sustainer and the power lines of the scan driver are provided on two different surfaces of the circuit board.

13. The method of claim 11, wherein the shortbar of the second bulk sustainer and the power lines of the scan driver are superimposed on two different surfaces of a double-layer flexible printed circuit being close to ends of the poles on the double-layer flexible printed circuit in a minimum predetermined distance so as to decrease the length of the parallel portions of the adjacent spaced apart parallel X and Y poles.

14. The method of claim 11, wherein the shortbar is provided on a periphery of the flexible printed circuits with a plurality of spaced apart parallel lines extended from either of two opposing ends of the shortbar toward the center, each of the spaced apart parallel lines connected to the corresponding X pole, and a plurality of spaced apart parallel lines provided on the centers of the flexible printed circuits each connected to the corresponding Y pole such that the lines are only spaced apart parallel each other in a minimum length in a predetermined region near either end of each of the flexible printed circuits adjacent to the shortbar.

15. The method of claim 14, further comprising an upward bent portion formed at either end of each of the flexible printed circuits adjacent to the shortbar so as to form a corresponding contact on the power lines at either end of the planar plane of each of the flexible printed circuits for pressed on ends of the X and Y poles on the front substrate.

16. The method of claim 14, wherein the shortbar is provided besides the left and right alignment marks of each of the flexible printed circuits.

* * * * *